US005513405A

United States Patent [19]

Bradbury, Jr. et al.

[11] Patent Number: 5,513,405

[45] Date of Patent: May 7, 1996

[54] MULTIPURPOSE RECYCLER'S TOOL

[75] Inventors: William B. Bradbury, Jr., Mendham, N.J.; S. Richard Averette, Murrells Inlet; Harry B. Ussery, Greenville, both of S.C.

[73] Assignee: The Bitterroot Company, Morristown, N.J.

[21] Appl. No.: 332,795

[22] Filed: Nov. 2, 1994

[51] Int. Cl.[6] ..... B26B 11/00

[52] U.S. Cl. ..... 7/158; 7/105; 30/123

[58] Field of Search ..... 7/105, 118, 158, 7/160; 30/2, 123

[56] References Cited

U.S. PATENT DOCUMENTS

| | | | |
|---|---|---|---|
| 699,207 | 5/1902 | Moe . | |
| 825,063 | 7/1906 | Lawbaugh . | |
| 1,277,290 | 8/1918 | Campbell . | |
| 1,277,767 | 9/1918 | Stafford . | |
| 1,561,993 | 11/1925 | Nielsen . | |
| 1,779,293 | 10/1930 | Rodgers . | |
| 3,562,826 | 2/1971 | Vaughn | 7/158 X |
| 3,774,252 | 11/1973 | Cantales . | |
| 4,856,132 | 8/1989 | Burns et al. | 7/118 |
| 4,870,754 | 10/1989 | Chiou | 30/123 |
| 5,303,469 | 4/1994 | Yin-Han | 30/2 |

OTHER PUBLICATIONS

United Airline's "High Street Emporium" Catalog, Holiday 93 (No. 28489).

Delta Air Line's Catalog, "Delta's World of Gifts", Holiday 94 (No. 28489).

*Primary Examiner*—James G. Smith

*Attorney, Agent, or Firm*—Fisher, Christen & Sabol

[57] ABSTRACT

A multipurpose combination-tool (for recyclers) which performs the functions of removing staples, scraping, identifying steel from other metallic recyclables like aluminum, cutting cardboard into dimensions appropriate for baling, removing plastic or metal cap retainer rings, stripping non-glued labels, cutting baling cord and various carton types, and removing pre-softened glue labels from bottles. The tool includes a scraper, a retractable hooked-shaped blade, a straight blade, a magnet, a passage way in the scraper, a housing with a comfortable grip and one set of extra blades stored in the housing.

17 Claims, 3 Drawing Sheets

MULTIPURPOSE RECYCLER' S TOOL

BACKGROUND OF THE INVENTION

1. Field Of The Invention

The invention relates to multipurpose combination-tools and, in particular, to those multipurpose combination-tools which are for use in recycling activities and for other personal and commercial purposes.

2. Description Of Related Art

U.S. Pat. No. 3,562,826 (Vaughn) discloses a multipurpose combination-tool which includes a scraping tool having a magnetic disc, a blade member/hammer, a handle and an aperture. U.S. Pat. No. 3,774,252 (Cantales) discloses a multipurpose combination tool which includes a spackling knife having a flat blade member, a chisel point which may be employed as a screw driver, picture hanger removers, a nail puller and a nail aperture. U.S. Pat. No. 699,207 (Moe) discloses a multipurpose combination-tool which includes a blade of a putty knife or other tool, a pair of projecting claws, a notched lock tumbler or eccentric and a screw driver or similar instrument. U.S. Pat. No. 1,561,993 (Nielsen) discloses a multipurpose combination-tool which includes a pair of pliers, a handle adapted to hold several different types of tools, a knife blade, a spring to hold blades or other tools in the extended or retracted position, lugs, a saw blade, a (chisel) blade, a pin, wire cutting shoulders, a chisel and a washer.

See also U.S. Pat. Nos. 1,779,923 (Rodgers), 825,063 (Lawbaugh), 1,277,290 (Campbell) and 1,277,767 (Stafford).

BROAD DESCRIPTION OF THE INVENTION

An object of the invention is to overcome the disadvantages of prior art recycling and other purpose tools. Another object of the invention is to provide a multipurpose recycling tool which has an efficient design, is simple to use and is economical to manufacture. Other objects and advantages of the invention are set out herein or are obvious herefrom to one skilled in the art.

The objects and advantages of the invention are achieved by the recycler's tool of the invention.

The invention involves a multi-functional, hand held and operated tool designed to fulfill several functions required to efficiently prepare household recyclables for curbside or depot recycling. The invention tool can also be used in warehouses and other private and commercial uses as multipurpose tools, e.g., whereever depacking is done.

Currently over 20 percent of all municipal solid waste is recycled. Commonly recycled materials include cardboard boxes, newspapers, glass and plastic bottles, steel and aluminum cans. The vast majority of these items are domestically generated. Recycling activity is prevalent where there exist high levels of popular environmental concern and awareness, for example, Vermont, and/or where there exist shortfalls of solid waste landfills and incinerator capacity, for example, New Jersey. As a general rule, the nation's highest levels of recycling activity are found in its most densely populated areas.

The separation, cleaning and pre-pickup or deposit preparation of recyclables are chores which are, to some extent, common to all households and businesses subject to mandated or voluntary recycling. These activities include: segregation of glass, plastics, aluminum and steel containers; cleaning of container residue, labels, retainer rings, tape, glue and contaminants; and pre-shipment preparation per numerous instructions issued by commercial recyclers, such as, bundling, baling, bagging and boxing. The recycler's tool of the invention helps the recycler meet many of these requirements.

The invention tool is convenient and has a functional focus, for example, as a household recycling multipurpose tool.

The invention involves a multipurpose recycler's tool, which includes, in combination: (a) a handle; (b) means for scraping and removing staples; (c) means for identifying steel and other ferrous materials from other recyclables; (d) means for cutting cardboard and other cuttable material into dimensions appropriate for baling or otherwise assembling; (e) means for removing, for example, plastic and metal cap retainer rings, stripping non-glued labels, cutting baling cord and various carton types, and removing pre-softened glue labels from bottles; and (f) means for hanging up said recycler's tool.

The invention involves a multipurpose recycler's tool, in more detail, includes a lower portion having a bottom surface, a lip, an area between the lip and the bottom surface, and an internal supporting ring. The internal supporting ring has a passage way in its middle. There is an upper portion having a bottom surface, an upper lip, an area between the lip and the bottom surface, an end which extends beyond the lower portion to form a scraper and an internal supporting ring. The internal supporting ring has a passage way in its middle and the upper portion fitting onto the lower portion. At least one screw is used to hold the lower portion and the upper portion together. There is a metal piece having a first hooked-shaped blade, a second hooked-shaped blade diametrically opposed to said first hooked-shaped blade. The metal piece has a hole in its center and two gaps. The first hooked-shaped blade has a cutting surface and a back side opposite to the cutting surface and the second hooked-shaped blade has a cutting surface and a back side opposite to the cutting surface. There is also a straight blade having a hole in the center of its base and having a cutting surface. A first base which is flat and almost circular with one flat edge. The first base has a protruding member onto which the hole in the straight blade is placed. There are two locking knobs almost diametrically opposed to one another and a hollow post. The hollow post has a lower half which fits into and rotates in the passage way in the middle of the internal supporting ring in the lower portion and has an upper half which fits into and rotates in the passage way in the middle of the internal supporting ring in the upper portion. There is a vertical locking member having two pins into which one of the locking knobs of the first base is positioned when the straight blade is in its open or in its storage position. There is further a second base upon which the metal piece is positioned and which may be slid back and fourth so that the cutting surface of the first hooked-shaped blade is either within the lower and the upper portions or extends beyond the lip of the lower and and the upper portions. The second base has a top side and a bottom side. There are outlines of a hooked-shaped blade and a straight blade in the bottom surface of the lower portion. A magnet is embedded in the tool.

The invention also involves a kit from which the multipurpose recycler's tool can be assembled. The kit includes: (a) a handle; (b) means for scraping and removing staples; (c) means for identifying steel and other ferrous materials from other recyclables; (d) means for cutting cardboard and other cuttable material into dimensions appropriate for baling or otherwise assembling; (d) means for removing, for example, plastic and metal cap retainer rings, stripping non-glued labels, cutting baling cord and various carton types, and removing pre-softened glue labels from bottles; and (f) means for hanging up said recycler's tool.

The kit can include a container for packaging for items (a) to (b).

The preferred embodiment of the invention is shown in the drawing.

The small device (preferably about 7 inches) employs two retractable, replaceable blades, a scraping surface which functions also as a stable remover, and a small magnet to identify steel from other metallic recyclables, like aluminum. The first of two blades is a straight inch knife blade (preferably about 2½ inches) designed to cut cardboard into dimensions appropriate for baling. The second of these blades preferably has two short diametrically opposed hooked-shape blades. It handily removes plastic or metal cap retainer rings, and also serves as a non-glued label stripper. Both of these blade types can be employed in cutting baling cord and various carton tapes. The scraper, which can be toothed, functions to remove pre-softened glue labels from bottles. The scraper also functions as a staple remover which is designed to dislodge large brass staples used to assemble corrugated shipping containers.

The tool is preferably designed in a two-half cross sectioned configuration. One half preferably houses the two functioning blades and two spare blades, while the other half serves as a detachable cover which provides access to the blades. This latter half also preferably includes the scraper appendage. The blades are standard stainless steel models (e.g., manufactured by Stanley and sold in hardware stores everywhere). The tool itself is preferably molded entirely of high grade, glass reinforced, recycled, nylon plastic. It has an in-molded textured grip and a magnetized steel disc permanently imbedded in the grip. A small hole through the scraper appendage serves as a hanging convenience.

Modifications and changes made to this recycler's tool can be effected without departing from the scope or the spirit of the present invention. For example, the length or shape of the tool can be altered without departing from the scope or spirit of the present invention. Also, the embodiments of this recycler's tool which are illustrated as follows have been shown only by way of example and should not be taken to limit the scope of the following claims.

DETAILED DESCRIPTION OF THE INVENTION

A list of the names/short identification of the parts of the invention tool in the figures is set out at the end of the specification.

Figure 1:
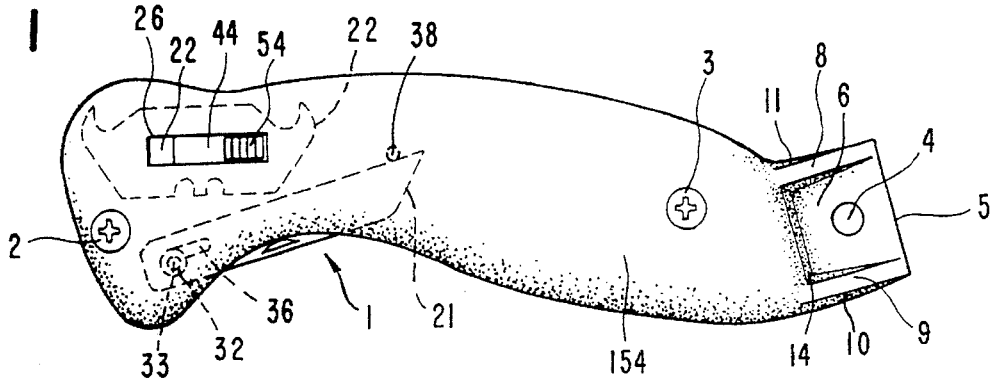
FIG. 1 is a top elevational view of the recycler's tool showing where the two blades are stored when not in use.
Figure 2:
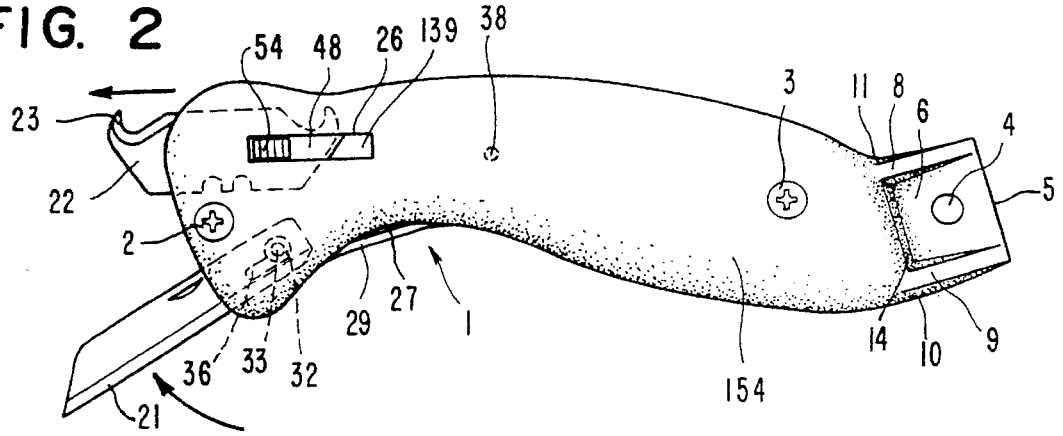
FIG. 2 is a top elevational view of the recycler's tool with each of the two blades in its extended position.
Figure 3:
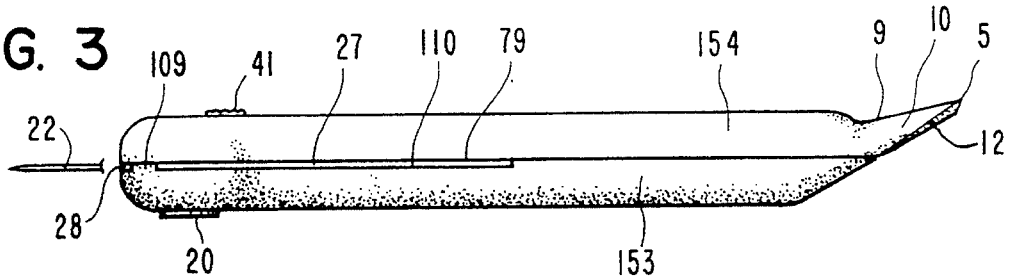
FIG. 3 is a side elevational view of the recycler's tool with each of the two blades in its non-extended (retracted) position and with the hooked-shaped blade in its extended position.
Figure 4:
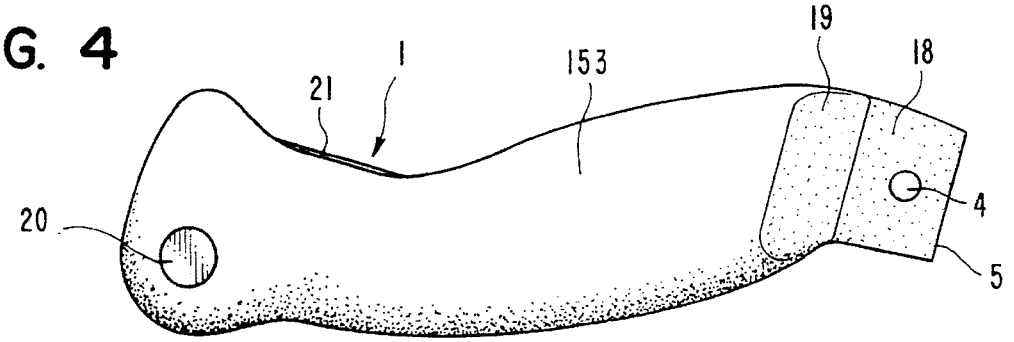
FIG. 4 is a bottom elevational view of the recycler's tool with each of the two blades in its non-extended (retracted) position.
Figure 5:
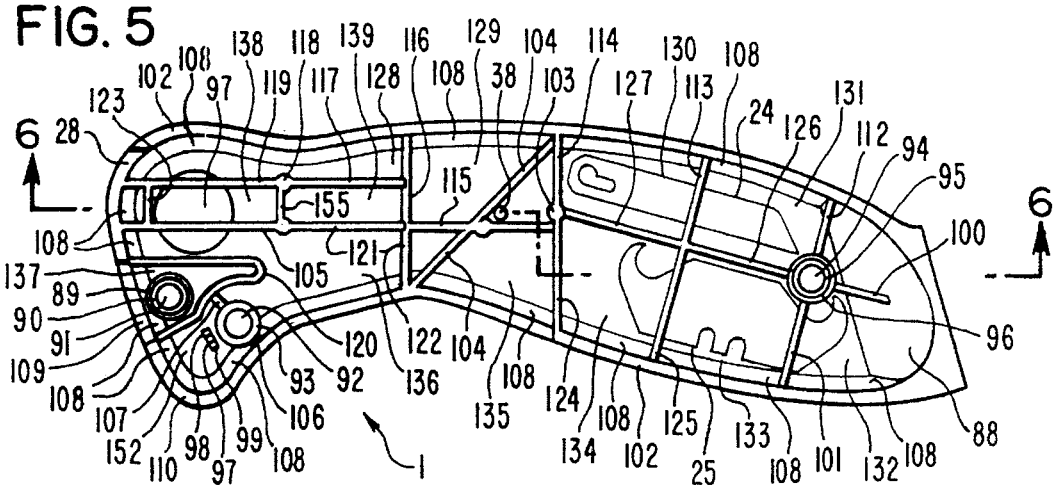
FIG. 5 is a top elevational view of the lower portion of the recycler's tool.
Figure 6:
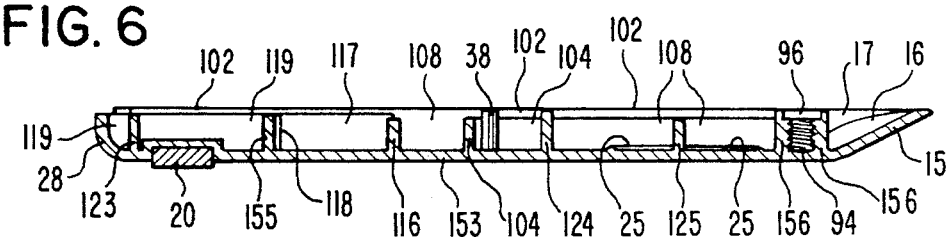
FIG. 6 is a cross-sectional side view along line 6—6 in FIG. 5 of the recycler's tool.
Figure 7:
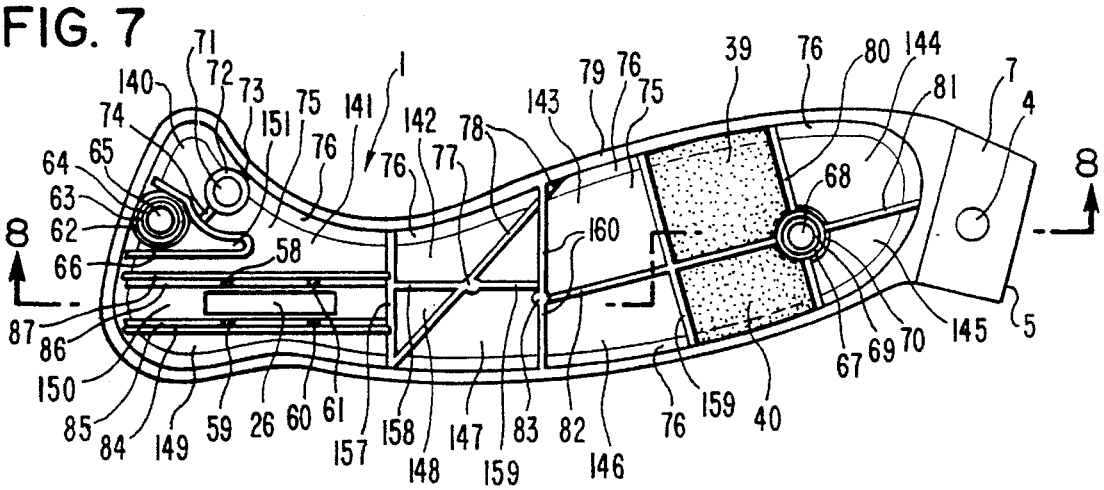
FIG. 7 is a top elevational view of the upper portion of the recycler's tool.
Figure 8:
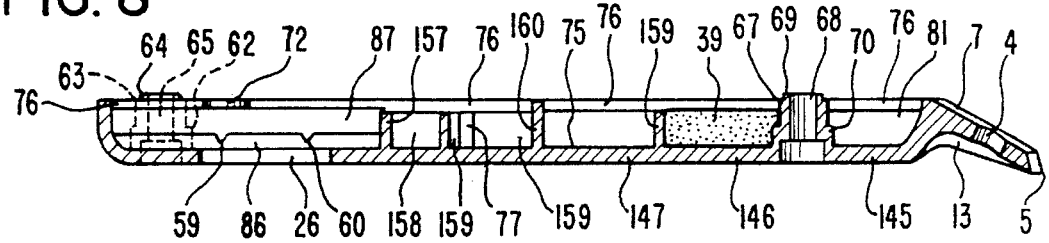
FIG. 8 is a cross-sectional side view along line 8—8 in FIG. 7 of the recycler's tool.
Figure 9:
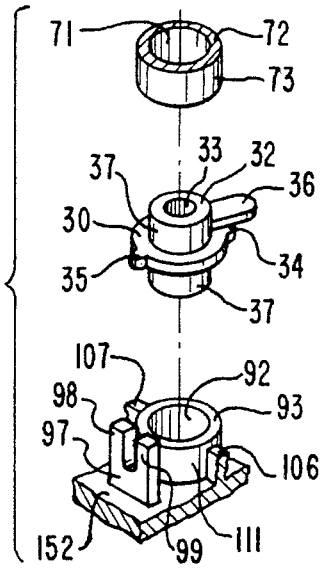
FIG. 9 is an exploded view of the pieces on which the straight blade of the recycler's tool pivots.
Figure 10:
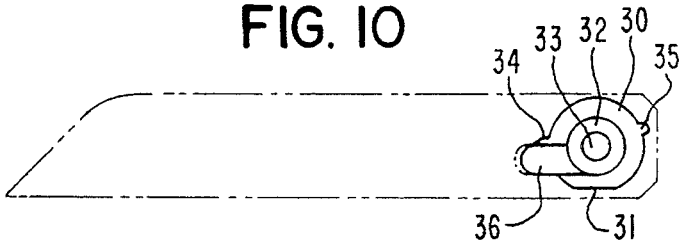
FIG. 10 is a top elevational view of the piece of the recycler's tool to which the straight blade attaches.
Figure 11:
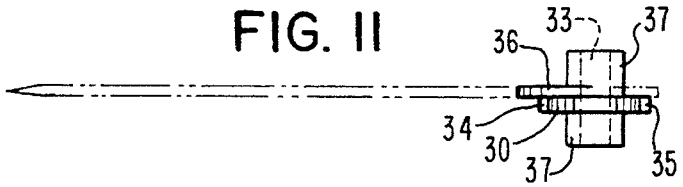
FIG. 11 is a side elevational view of the piece of the recycler's tool to which the straight blade attaches.
Figure 12:
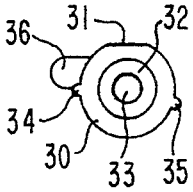
FIG. 12 is a bottom elevational view of the piece of the recycler's tool to which the straight blade attaches.
Figure 13:
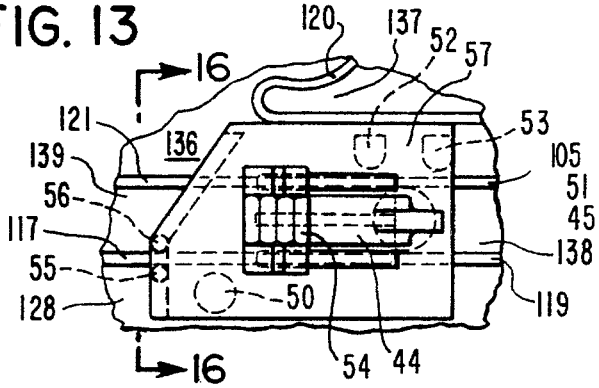
FIG. 13 is a top elevational view of the piece of the recycler's tool to which the hooked-shaped blade attaches.
Figure 14:
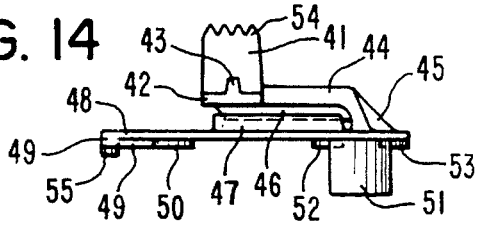
FIG. 14 is a side elevational view of the piece of the recycler's tool to which the hooked-shaped blade attaches.
Figure 15:
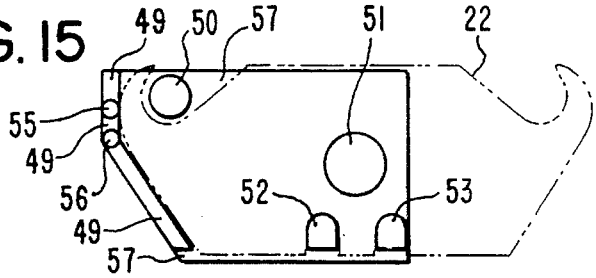
FIG. 15 is a bottom elevational view of the piece of the recycler's tool to which the hooked-shaped blade attaches.
Figure 16:
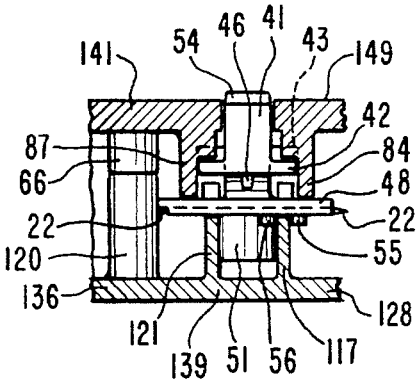
FIG. 16 is a side elevational view of the piece of the recycler's tool to which the hooked-shaped blade attaches and the immediately surrounding areas.

As shown in the accompanying drawings, FIGS. 1 through 16, the recycler's tool of the present invention generally comprises two portions, an upper portion (154) and a lower portion (153) which fit together. Two screws (2 and 3) hold the two portions together. Both portions are molded entirely of high grade, glass reinforced, recycled, nylon plastic, as are all of the parts in the recycler's tool except for the metal pieces having two diametrically opposed hooked-shaped blades and the straight blades (22 and 21). One end of the upper portion extends beyond the lower portion to form a scraper having a scraping surface (5), an upper surface which is recessed in its middle section (6) and extends (13 and 14) to outer ridges (8 and 9), side panels (10 to 12) and a bottom surface (7 and 18). There is a passage way —small hole—in the center of the scraper appendage (4) which can be used, for example, to hang up the recycler's tool on, for example, a nail. One end of the lower portion curves upward (16, 19 and 88) from its bottom surface to the area from which the scraper extends in the upper portion.

The tool is angled so that there is an area which is easy to grip (1) on the side of the tool oppose of the scraper (5 to 14).

Embedded in the outer surface of the lower portion is a small, circular magnet (28). The magnet can be used to distinguish between steel and other metallic recyclables like aluminum.

The interior side of the lower portion has a bottom surface (15, 16, 88, 128 to 139 and 152), an inner wall (17 and 108) and a lip (102 and 109). A number of internal supporting ribs (100 to 101, 104 to 107, 112 to 117, 119 to 127 and 155) and posts (103, 118) for structural strength. An outline of each of the two blade types (24 and 25) is present on the bottom surface (130 to 134) of the lower portion. On top of these outlines, on top of several internal supporting ribs (100, 101, 113,125 to 127), an extra straight blade (21) and an extra metal piece having two diametrically opposed hooked-shaped blades (22) are stored. Supporting ribs (100, 101, 112, 113, 125 to 127) in the lower portion benath the blades are recessed, so that the blades fit between the two portions.

The supporting ribs (104,115 to 122) in the area over which the straight blade (not the extra one) is stored are also recessed so that the straight blade is able to be moved from a storage position in the knife through a passage way (29) to an open position 180 degrees therefrom. Likewise, the lip of the lower portion (110) through which the straight blade is moved is recessed relative to the lip of the rest of the lower portion (102). A pillar (38) is present against which the cutting surface of the straight blade rests while it is in its storage position.

A hole in the back of the straight blade (21) fits onto a base (30) through a protruding member (41). The base is flat (31) and almost circular, with one flat edge (31). It has two locking knobs (34 and 35) almost diametrically opposed to one another. A hollow post (32, 33 and 37) runs through the base. The lower half of the hollow post fits into and rotates in the passage way (92) in the middle of the internal supporting ring (93 and 111) in the interior of the lower portion. A vertical locking member (97) having two pins (98 and 99) offers some resistance when the straight blade is moved from either its storage or its open position. The upper half of the hollow post (32, 33 and 37) fits into and rotates in the passage way (71) in the middle of the internal supporting ring (72) in the interior of the upper portion.

The interior side of the upper portion has a bottom surface (75, 140 to 151), an upper lip (79), an area between the upper lip and the bottom surface of the upper portion (76), and a number of internal supporting ribs (66, 73, 74, 78, 80 to 82, 84, 87 and 157 to 160), a pillar (77) and a post (83) for structural strength. The internal supporting ribs (80 to 82 and 159) in the upper portion above the outlines of each of the blade types (24 and 25) in the lower portion are recessed so that the extra blades can be stored there. Sponge-like material (39 and 40) is present in two cavities between two internal supporting ribs (80 and 159) above where the extra blades are stored. The sponge-like material prevents the blades from moving around while the recycler's tool is in use.

The lip (102 and 109) of the lower portion is recessed (28) where the metal piece having two diametrically opposed hooked-shaped blades may be projected from the lower portion. The metal piece is placed on a base (48) which slides over internal supporting ribs (105, 117, 119, 121, 123 and 155). These internal supporting ribs are recessed to form an internal slide area. The post (51) on the bottom side of the base (57) fits through the hole of the metal piece. A circular protrusion (50) on the base fits into the cutting surface (23) of the second hooked-shaped blade, that is, not on the side of the blade which may be projected from the lower portion. The protrusions (52 and 53) on the base fit securely into two gaps on the blade. The back side of the second hooked-shaped blade lays alongside a ledge (49) protruding from the base. The post on the bottom side of the base has a circumference slightly less than the distance between the two internal supporting ribs (105 and 119) through which it slides. When the first hooked-shaped blade is projected from the tool, two circular protrusions (55 and 56) extend from the ledge on the base, each running along an opposite side of the internal supporting rib (117).

A cantilevered member (44) projects from the side of the base (48) opposite to the side from which the post (51) projects. There are two stiffening ribs for the cantilevered member (45 and 46). On the end of the cantilevered member opposite to where it projects from the base is a protruding member (41) with a rough upper surface (54). The rough upper surface of the protruding member extends up through the passage way (26) in the upper portion. A track (47) runs along each side of the cantilevered member from must beyond where it projects from the base to its diametrically opposed end. On diametrically opposite sides of the protruding member (41), perpendicular to the cantilevered member, are ledges (42) with protruding members (43). A ledge (85 and 86) runs along beside the inside of each of the two supporting ribs (84 and 87) bordering the passage way (26). There are two notches (58 to 61) on each of these two ledges. When the rough upper surface (54) of the protruding member (41) is pushed to one end of the passage way (26) or the other (causing the hooked-shaped blade to be in either its extended position or its storage position), each of the protruding members (43) fits into one of the notches. The notches provide resistance for these knife positions.

On opposite sides of both the lower portion and the upper portion are supporting rings (62, 63, 67, 70, 90, 95 and 156) in which the two screws (2 and 3) are placed to hold the two portions together. The supporting rings in the upper portion have protruding lips (64 and 69) which fit into the protruding lips (89 and 96) of the supporting rings in the lower portion. The screws are placed through the passage ways (65 and 68) in the center of the supporting rings in the upper portion into the internally threaded holes (91 and 94) of the lower portion a slight gap (27) exists between the recess lip (110) of the lower portion and the upper lip (79) of the upper portion.

By way of partial summary, the invention tool (e.g., useful as a recycling tool includes two retractable, replaceable blades (one hooked), a scraping surface which may also function as a staple remover, and a small magnet to identify steel and ferrous materials from other metallic recyclables, such as, aluminum.

More specifically, the invention involves a small, hand held device/tool, for example, useful as a recycler's tool, which employs two retractable, replaceable blades, a scraping surface which functions also as a staple remover, and a small magnet to identify steel from other metallic recyclables, such as aluminum. The first of the two blades is a straight (preferably about 2½ inches) knife blade. The second of these blades has a short hooked shape. The tool is designed in a two-half cross sectional configuration. One half houses the two functioning blades and two spare blades, while the other half serves as a detachable cover which provides access to the blades. This half also includes the scraper appendage. The blades are typically standard stainless steel. The tool itself is preferably molded entirely of high grade, glass reinforced, recycled, nylon plastic. It has an in-molded textured grip and a magnetized steel disc permanently embedded in the grip. A small hole through the scraper appendage serves as a hanging convenience.

LIST OF PARTS NUMBERS

In connection with the figures, the following list of the names of the parts of the instant invention are noted:

1 grip
2 screw
3 screw
4 passage way
5 scraping surface
6 recessed surface of scraper (upper surface)
7 bottom surface of scraper
8 ridge on upper surface of scraper
9 ridge on upper surface of scraper
10 side panel of scraper
11 side panel of scraper
12 side panel of scraper
13 surface extending from recessed surface of scraper to ridge on upper surface of scraper (9)
14 surface extending from recessed surface of scraper to upper surface of scraper
15 cross-section of lower portion
16 interior of angled section of lower portion
17 inner wall of lower portion
18 bottom surface of scraper
19 exterior of angled surface of lower portion
20 magnet
21 straight blade
22 metal piece having two diametrically opposed hooked-shaped blades
23 cutting surface of hooked-shaped blade
24 ridge outline where extra straight blade is stored
25 outline where extra metal piece is stored
26 passage way
27 gap
28 passage way through which the hooked-shaped blade slides
29 passage way through which the straight blade slides
30 base
31 flat edge of base
32 upper lip of post
33 hole
34 locking knob
35 locking knob
36 protruding member
37 sides of post
38 pillar
39 sponge-like material
40 sponge-like material
41 protruding member
42 ledge
43 protruding member
44 cantilevered member
45 stiffening rib for cantilevered member
46 stiffening rib for cantilevered member
47 track
48 base
49 ledge
50 circular protrusion
51 post
52 protrusion
53 protrusion
54 rough upper surface of protruding member
55 circular protrusion
56 circular protrusion
57 bottom of base
58 notch in ledge
59 notch in ledge
60 notch in ledge
61 notch in ledge
62 internal supporting ring
63 internal supporting ring
64 protruding lip of internal supporting ring
65 passage way
66 internal supporting rib
67 internal supporting ring
68 passage way
69 protruding lip of internal supporting ring
70 internal supporting ring
71 passage way
72 internal supporting ring
73 internal supporting rib
74 internal supporting rib
75 bottom surface of the interior of the upper portion
76 area between lip and bottom surface of upper portion
77 pillar
78 internal supporting rib
79 upper lip
80 internal supporting rib
81 internal supporting rib
82 internal supporting rib
83 post
84 internal supporting rib
85 ledge
86 ledge
87 internal supporting rib
88 angled bottom surface of lower portion 89 protruding supporting lip
90 internal supporting ring
91 internally threaded hole
92 passage way
93 top lip of internal supporting ring
94 internally threaded hole
95 internal supporting ring
96 protruding supporting lip
97 locking member
98 pin on locking member
99 pin on locking member
100 internal supporting rib
101 internal supporting rib
102 lip of lower portion
103 post
104 internal supporting rib
105 internal supporting rib
106 internal supporting rib
107 internal supporting rib
108 area between lip and bottom surface of lower portion
109 lip of lower portion
110 recessed lip of lower portion
111 internal supporting ring
112 internal supporting rib
113 internal supporting rib
114 internal supporting rib
115 internal supporting rib
116 internal supporting rib
117 internal supporting rib
118 post
119 internal supporting rib
120 internal supporting rib
121 internal supporting rib
122 internal supporting rib
123 internal supporting rib
124 internal supporting rib
125 internal supporting rib
126 internal supporting rib
127 internal supporting rib
128 bottom surface of lower portion
129 bottom surface of lower portion
130 bottom surface of lower portion
131 bottom surface of lower portion
132 bottom surface of lower portion
133 bottom surface of lower portion
134 bottom surface of lower portion
135 bottom surface of lower portion
136 bottom surface of lower portion
137 bottom surface of lower portion
138 bottom surface of lower portion
139 bottom surface of lower portion
140 bottom surface of upper portion
141 bottom surface of upper portion
142 bottom surface of upper portion
143 bottom surface of upper portion
144 bottom surface of upper portion
145 bottom surface of upper portion
146 bottom surface of upper portion
147 bottom surface of upper portion
148 bottom surface of upper portion
149 bottom surface of upper portion
150 bottom surface of upper portion
151 bottom surface of upper portion
152 bottom surface of lower portion
153 lower portion
154 upper portion
155 internal supporting rib
156 walls of chamber in which screw is placed
157 internal supporting rib
158 internal supporting rib
159 internal supporting rib
160 internal supporting rib.

What is claimed:

1. A multipurpose recycler's tool, comprising, in combination:

(a) a lower portion having a bottom surface, a lip, an area between the lip and the bottom surface, and an internal supporting ring, said internal supporting ring having a passage way in its middle;

(b) an upper portion having a bottom surface, an upper lip, an area between the lip and the bottom surface, an end which extends beyond the lower portion to form a scraper and an internal supporting ring, said internal supporting ring having a passage way in its middle and said upper portion fitting onto said lower portion;

(c) means for holding the lower portion and the upper portion together so as to form a handle;

(d) a metal piece having a first hooked-shaped blade, a second hooked-shaped blade diametrically opposed to said first hooked-shaped blade, said metal piece having a hole in its center and two gaps, said first hooked-shape blade having a cutting surface and a back side opposite to said cutting surface and a back side opposite to said cutting surface;

(e) a straight blade having a hole in the center of its base and having a cutting surface;

(f) a first base, said first base being flat and almost circular with one flat edge and said first base having a protruding member onto which the hole in the straight blade is placed, two locking knobs almost diametrically opposed to one another and a hollow post, said hollow post having a lower half which fits into and rotates in the passage way in the middle of the internal supporting ring in the lower portion and having an upper half which fits into and rotates in the passage way in the middle of the internal supporting ring in the upper portion;

(g) a vertical locking member having two pins into which one of the locking knobs of said first base is positioned when the straight blade is in its open or in its storage position;

(h) a second base upon which said metal piece is positioned and which may be slid back and forth so that the cutting surface of the first hooked-shaped blade is either within said lower and said upper portions or extends beyond the lip of said lower and said upper portions, said second base having a top side and a bottom side;

(i) an outline of a hooked-shaped blade in the bottom surface of the lower portion;

(j) an outline of a straight blade in the bottom surface of the lower portion; and (k) a magnet embedded in said tool.

2. The multipurpose recycler's tool according to claim 1, further comprising:

(l) an extra metal piece and an extra straight blade, said extra metal piece and said extra straight blade being positioned on the internal supporting ribs above the outline of the metal piece and the outline of the straight blade in the lower portion; and (m) at least two pieces of sponge-like material positioned in the upper portion above the extra hooked-shaped blade and the extra straight blade to cushion the extra hooked-shaped blade and the extra straight blade.

3. The multipurpose recycler's tool according to claim 1, further comprising at least two pieces of sponge-like material, said at least two pieces of sponge-like material being positioned in the upper portion above the hooked-shaped blade rib outline and the straight blade rib outline.

4. The multipurpose recycler's tool according to claim 1, wherein the scraper has a passage way in it for hanging the recycler's tool.

5. The multipurpose recycler's tool according to claim 1, wherein the upper portion, the lower portion, the first base and the second base are molded entirely of high grade, glass reinforced, recycled, nylon plastic.

6. The multipurpose recycler's tool according to claim 1, wherein the scraper comprises:

(n) a scraping surface;

(o) outer ridges running perpendicular to the scraping surface;

(p) a recessed middle section extending between the outer ridges;

(q) side panels; and (r) a bottom surface.

7. The multipurpose recycler's tool according to claim 1, wherein the lower portion and the upper portion are angled to form an area on the recycler's tool which is easy to grip.

8. The multipurpose recycler's tool according to claim 1, wherein the lower portion further comprises at least one internal supporting rib and at least one post for structural strength, and wherein the upper portion further comprises at least one internal supporting rib and at least one post for structural strength.

9. The multipurpose recycler's tool according to claim 1, further comprising a pillar (38) against which the cutting surface of the straight blade rests while in its storage position.

10. The multipurpose recycler's tool according to claim 1, further comprising at least one supporting ring in the upper portion and at least one supporting ring in the lower portion, said at least one supporting ring in the upper portion having protruding lips and said at least one supporting ring in the lower portion having protruding lips and an internally threaded hole, said at least one supporting ring in the upper portion fitting into said at least one supporting ring in the lower portion, and said at least one screw fitting through said at least one supporting ring in the upper portion into the internally threaded hole in the at least one supporting ring in the lower portion.

11. The multipurpose recycler's tool according to claim 1, wherein the magnet is embedded in the lower portion.

12. A multipurpose recycler's tool according to claim 1, further comprising a passage way in said upper portion above where said metal piece is positioned while it is slid back and forth, and wherein said second base includes:

(s) a post extending from the bottom side over which the hole in the center of the hooked-shaped blade fits;

(t) a circular protrusion having a side wall, the cutting surface of the hooked-shaped blade resting against said wall of said circular protrusion;

(u) two protrusions securely fitting into said two gaps in said metal piece;

(v) a ledge protruding from said second base, said back side of said second hooked-shaped blade laying alongside said ledge;

(w) a cantilevered member projecting from the top side of said second base;

(x) two stiffening ribs projecting from said cantilevered member;

(y) a protruding member extending from the top side of said second base up through said passage way in said upper portion above where said metal piece is positioned while it is slid back and forth, said protruding member having a first ledge and a second ledge, said first ledge and said second ledge being on the sides of the protruding member perpendicular to said cantilevered member and said first ledge and said second ledge each having a protruding member extending from it;

(z) a first supporting rib extending along one side of said passage way in said upper portion, said first supporting rib having a notch near each end of it into which said protruding member of said first ledge may be positioned;

(aa) a second supporting rib extending along the side of said passage way in the upper portion opposite to the side of said passage way in the upper portion along which said first supporting rib runs, said second supporting rib having a notch near each end of it into which said protruding member of said second ledge may be positioned;

(bb) a first track running alongside said protruding member from where said protruding member extends from the top side of said second base to just beyond where it extends through said passage way in said upper portion; and (cc) a second track running alongside said protruding member from where said protruding member extends from the top side of said second base to just beyond where it extends through said passage way in said upper portion said second track not being on the same side of said protruding member as said first track.

13. The multipurpose recycler's tool according to claim 12, wherein said protruding member has a rough upper surface.

14. The multipurpose recycler's tool according to claim 12, further comprising two internal supporting ribs between which said post extending from the bottom section of said second base slides when pressure is applied to said protruding member of said second base, and a first circular protrusion and a second circular protrusion, said first and second protrusions projecting from said ledge, said first protrusion moving alongside one side of said ledge and said second protrusion moving alongside the opposite side of said ledge when pressure is applied to said protruding member of said second base.

15. The multipurpose recycler's tool according to claim 1, wherein said means for holding the lower and the upper portion together is at least one screw.

16. A multipurpose recycler's tool, comprising, in combination:

(a) a lower portion;

(b) an upper portion adapted to engage the lower portion and having an end which forms a scraper;

(c) a hooked-shaped blade having a cutting surface;

(d) means for sliding the cutting surface of the hooked-shaped blade in and out of said lower portion and said upper portion;

(e) a straight blade having a cutting surface;

(f) means for rotatably mounting said straight blade within said lower portion and said upper portion and being adapted so that said straight blade can be rotated between an open position outside of both said upper portion and said lower portion, whereby the cutting surface is exposed, and a storage position within said lower portion and said upper portion; and (g) a magnet embedded in said tool.

17. A multipurpose recycler's tool according to claim 16, further comprising means for holding the lower portion and the upper portion together so as to form a handle.

* * * * *